US011312129B2

(12) United States Patent
Martin et al.

(10) Patent No.: US 11,312,129 B2
(45) Date of Patent: Apr. 26, 2022

(54) FLUIDIC DIES WITH SELECTORS ADJACENT RESPECTIVE FIRING SUBASSEMBLIES

(71) Applicant: Hewlett-Packard Development Company, L.P., Spring, TX (US)

(72) Inventors: Eric Martin, Corvallis, OR (US); James R. Przybyla, Corvallis, OR (US); Daryl E. Anderson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/267,542

(22) PCT Filed: Nov. 21, 2018

(86) PCT No.: PCT/US2018/062247

§ 371 (c)(1),
(2) Date: Feb. 10, 2021

(87) PCT Pub. No.: WO2020/106289

PCT Pub. Date: May 28, 2020

(65) Prior Publication Data

US 2021/0316551 A1 Oct. 14, 2021

(51) Int. Cl.
*B41J 2/045* (2006.01)
*B41J 2/14* (2006.01)

(52) U.S. Cl.
CPC ..... *B41J 2/04555* (2013.01); *B41J 2/0455* (2013.01); *B41J 2/0458* (2013.01); *B41J 2/14153* (2013.01)

(58) Field of Classification Search
CPC ..... B41J 2/04505; B41J 2/04586; B41J 2/16526; B41J 2/16508; B41J 2/01; B41J 3/407; B41J 2/04503; B41J 2/04508; B41J 2/0451; B41J 2/04513; B41J 2/04515; B41J 2/0452; B41J 2/04525; B41J 2/0454; B41J 2/04548; B41J 2/04553; B41J 2/04555; B41J 2/04565; B41J 2/04538; B41J 2/04568; B41J 2/0457
See application file for complete search history.

(56) References Cited

U.S. PATENT DOCUMENTS

| | | | |
|---|---|---|---|
| 6,302,504 | B1 | 10/2001 | Imanaka et al. |
| 7,604,321 | B2 | 10/2009 | Sheahan et al. |
| 9,656,464 | B1 | 5/2017 | Edelen et al. |
| 2002/0008738 | A1 | 1/2002 | Lee et al. |
| 2009/0102890 | A1 | 4/2009 | Rohlfing et al. |
| 2014/0354720 | A1 | 12/2014 | Kasai et al. |
| 2015/0062222 | A1 | 3/2015 | Ghozeil et al. |
| 2016/0297198 | A1 | 10/2016 | Edelen et al. |

*Primary Examiner* — Kristal Feggins
(74) *Attorney, Agent, or Firm* — Fabian VanCott

(57) ABSTRACT

In one example in accordance with the present disclosure, a fluidic die is described. The fluidic die includes an array of firing subassemblies grouped into zones. Each firing subassembly includes 1) a firing chamber, 2) a fluid actuator, and 3) a sensor plate. The fluidic die also includes a measurement device per zone to measure a voltage indicative of an impedance within a selected firing chamber. The fluidic die includes a selector per firing subassembly to couple a selected sensor plate to the measurement device. A selector is adjacent a respective firing subassembly and a distance between the selector and the measurement device is different as compared to other selectors.

20 Claims, 4 Drawing Sheets

FLUIDIC DIES WITH SELECTORS ADJACENT RESPECTIVE FIRING SUBASSEMBLIES

BACKGROUND

A fluidic die is a component of a fluidic system. The fluidic die includes components that manipulate fluid flowing through the system. For example, a fluidic ejection die, which is an example of a fluidic die, includes a number of firing subassemblies that eject fluid onto a surface. The fluidic die also includes non-ejecting actuators such as micro-recirculation pumps that move fluid through the fluidic die. Through these firing subassemblies and pumps, fluid, such as ink and fusing agent among others, is ejected or moved. Over time, these firing subassemblies and pumps can become clogged or otherwise inoperable. As a specific example, ink in a printing device can, over time, harden and crust. This can block the firing subassembly and interrupt the operation of subsequent ejection events. Other examples of issues affecting these actuators include fluid fusing on an ejecting element, particle contamination, surface puddling, and surface damage to die structures. These and other scenarios may adversely affect operations of the device in which the fluidic die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
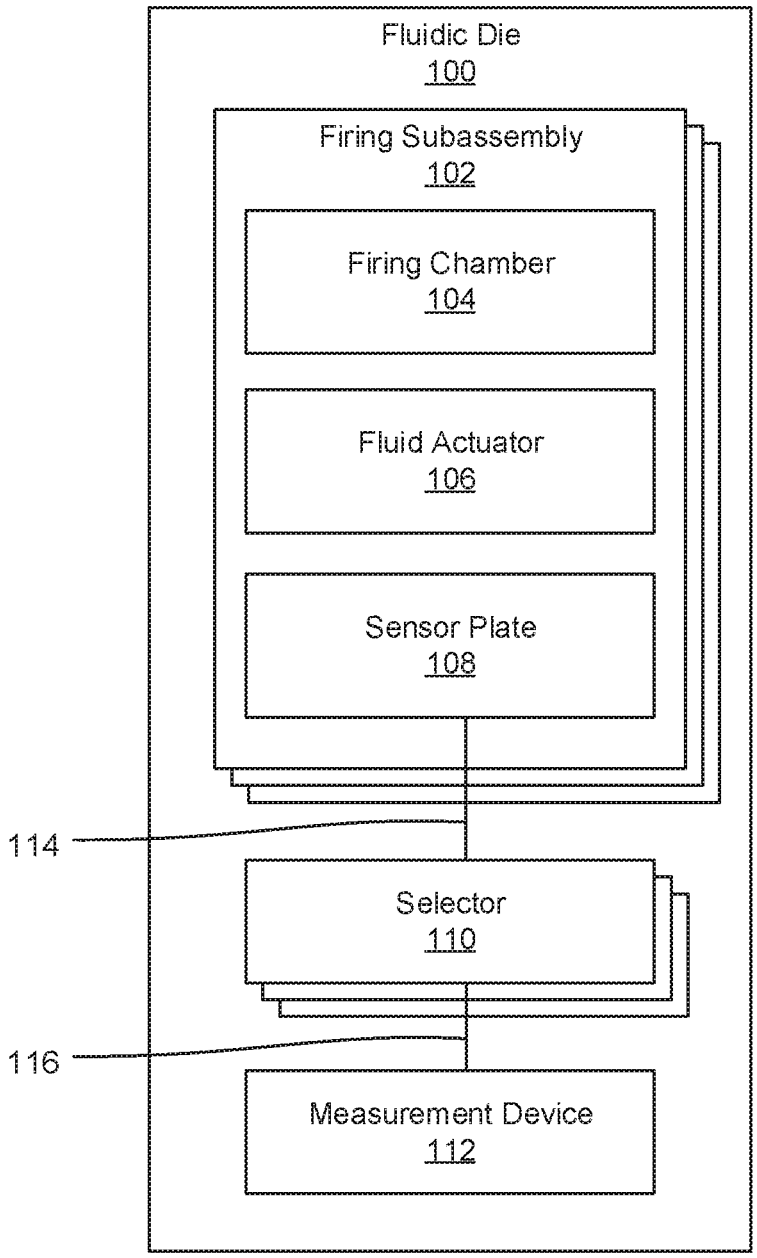
FIG. 1 is a block diagram of a fluidic die with a selector adjacent a respective firing subassembly, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as those found in printers, additive manufacturing distributor components, digital titration components, and/or other such devices with which volumes of fluid may be selectively and controllably ejected.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluidic systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product.

Each fluidic die includes a fluid actuator to eject/move fluid. A fluid actuator may be disposed in an ejection subassembly, where the ejection subassembly includes an ejection chamber and an opening in addition to the fluid actuator. The fluid actuator in this case may be referred to as an ejector that, upon actuation, causes ejection of a fluid drop via the opening.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

While such fluidic systems and dies undoubtedly have advanced the field of precise fluid delivery, some conditions affect their effectiveness. For example, the fluid actuators on a fluidic die are subject to many cycles of heating, drive bubble formation, drive bubble collapse, and fluid replenishment from a fluid reservoir. Over time, and depending on other operating conditions, the fluid actuators may become blocked or otherwise defective. For example, particulate matter, such as dried ink or powder build material, can block the opening. This particulate matter can adversely affect the formation and release of subsequent fluid. Other examples of scenarios that may affect the operation include a fusing of the fluid on the actuator element, surface puddling, and general damage to components within the firing chamber. As the process of depositing fluid on a surface, or moving a fluid through a fluidic die is a precise operation, these blockages can have a deleterious effect on print quality or other operation of the system in which the fluidic die is disposed. If one of these actuators fails, and is continually operating following failure, then it may cause neighboring actuators to fail.

Accordingly, the present specification is directed to determining a state of a particular fluid actuator and/or identifying when a fluid actuator is blocked or otherwise malfunctioning. Following such an identification, appropriate measures such as actuator servicing and actuator replacement can be performed. Specifically, the present specification describes such components as being located on the die.

To perform such identification, a fluidic die of the present specification includes a number of sensor plates, each of which is disposed in a firing chamber of a respective firing subassembly. A measurement device, which is coupled to multiple sensor plates, forces a current onto a selected sensor plate and after a determined period of time, the measurement device measures the voltage detected on the sensor plate. This detected voltage can be used to determine a state of the conditions within the firing chamber.

However, the evaluation of different firing subassemblies may be affected by the layout of the fluidic die. For example, each firing subassembly may be coupled to a selector which couples the respective firing subassembly, and just that firing subassembly, to the measurement device for evaluation. In some examples, the selector may be near the measurement device. However, it may be the case that a distance between a firing subassembly and the respective selector may be different. As a specific example, arrays of firing subassemblies may be arranged as angled columns. Accordingly, a distance between a firing subassembly at a top of the column and its selector may be very different from a distance between a firing subassembly at the bottom of the column and its selector.

Transmission lines run between the measurement device and selectors that couple a particular firing subassembly to the measurement device. Transmission lines also run between a particular selector and the respective firing subassembly. When transmission lines are not coupled in parallel, the inherent parasitic capacitance on them can alter the measurement operation. For example, in an angled column array as described above the distance between firing subassemblies and their respective selectors may be different. The different lengths mean that each firing subassembly may have a parasitic capacitance that differs from other firing subassemblies in the zone.

As described above, a voltage is received at a measurement device which is used to determine a firing subassembly state. However, parasitic capacitance along the transmission path alters the received voltage value. Accordingly, different paths with different parasitic capacitances result in the voltage value received at the measurement device varying to different degrees, depending on the firing subassembly being tested. This variation could lead to an incorrect determination of firing subassembly state.

For example, a certain voltage value may map to a particular actuator state. The voltage response of the sensor plate to stimulus from the measurement device may vary based on the parasitic capacitance. The voltage response may be different enough such that the voltage value received by the measurement device maps to a different actuator state. The difference in the mapping may result in the fluid actuator being misclassified. Thus, a degree of uncertainty or error is introduced into subassembly state determination based on small variations in parasitic capacitance between the different firing subassemblies. This variation in parasitic capacitance is due to different lengths of the transmission paths between selectors and respective firing subassemblies.

Accordingly, the present specification describes fluidic dies and systems to alleviate these and other issues. Specifically, the present fluidic die includes transmission paths with uniform parasitic capacitance such that any variation of a voltage received by the measurement device is the same for all firing subassemblies on a fluidic die. This may be done first by having selectors coupled in parallel to the measurement device. As they are in parallel, any parasitic capacitance along any selector/measurement device line is common across the zone. Second, the selector is placed adjacent the firing subassembly such that any parasitic capacitance between the selector and the respective firing subassembly is small and the same for each firing subassembly. Thus, the parasitic capacitance along the entire path from a firing subassembly to the measurement device is uniform due to 1) shared selector/measurement paths and 2) equidistant and short selector/sensor plate paths.

Specifically, the present specification describes a fluidic die. The fluidic die includes an array of firing subassemblies grouped into zones. Each firing subassembly includes 1) a firing chamber, 2) a fluid actuator disposed within the firing chamber, and 3) a sensor plate disposed within the firing chamber. The fluidic die also includes a measurement device per zone to measure a voltage indicative of an impedance within a selected firing chamber. The fluidic die also includes a selector per firing subassembly to couple the selected sensor plate to the measurement device. In this example, the selector is adjacent a respective firing subassembly and a distance between the selector and the measurement device is different as compared to at least one other selector In another example, the fluidic die includes an array of firing subassemblies grouped into zones wherein the array comprises an angled column of firing subassemblies. As described above each firing subassembly includes 1) a firing chamber, 2) a fluid actuator disposed within the firing chamber, and 3) a sensor plate disposed within the firing chamber. The fluidic die also includes the measurement device per zone that measures a voltage indicative of an impedance within a selected firing chamber. The fluidic die also includes the selector per firing subassembly to couple the selected sensor plate to the measurement device. In this example, 1) the selector is adjacent a respective ejection subassembly, 2) a parasitic capacitance along a path between each respective sensor plate and selector is uniform, 3) a distance between the selector and the measurement device is different as compared to at least one other selector, and 4) a distance between the selector and its associated sensor plate is the same as other selectors.

The present specification also describes a fluidic system. The fluidic system includes a fluidic die. The fluidic die includes an array of firing subassemblies grouped into zones. Each firing subassembly includes 1) a firing chamber, 2) a fluid actuator disposed within the firing chamber, and 3) a sensor plate disposed within the firing chamber. The fluidic die also includes a measurement device per zone to measure a voltage indicative of an impedance within a selected firing chamber. The fluidic die also includes a selector per firing subassembly to couple the selected sensor plate to the measurement device. In this example, the selector is adjacent a respective firing subassembly and a distance between the selector and the measurement device is different as compared to at least one other selector. The fluidic system also includes a controller to, based on an output of the measurement device, determine a state of a selected firing subassembly.

In one example, using such a fluidic die 1) makes the parasitic capacitance of the various transmission paths on a fluidic die uniform; 2) provides consistent data on which subsequent voltage-to-state mappings can rely; 3) allows for accurate, repeatable, and consistent actuator evaluation; and 4) capitalizes on available spaced on the fluidic die.

As used in the present specification and in the appended claims, the term "fluid actuator" refers an ejecting fluid actuator and/or a non-ejecting fluid actuator. For example, an ejecting fluid actuator operates to eject fluid from the fluidic ejection die. A recirculation pump, which is an example of a non-ejecting fluid actuator, moves fluid through the fluid slots, channels, and pathways within the fluidic die.

Accordingly, as used in the present specification and in the appended claims, the term "firing subassembly" refers to an individual component of a fluidic die that ejects/moves fluid.

Further, as used in the present specification and in the appended claims, the term "fluidic die" refers to a component of a fluid system that includes a number of fluid actuators. A fluidic die includes fluidic ejection dies and non-ejecting fluidic dies.

Turning now to the figures, FIG. 1 is a block diagram of a fluidic die (100) with a selector (110) adjacent a respective firing subassembly (102), according to an example of the principles described herein. As described above, the fluidic die (100) is a part of the fluidic system that houses components for ejecting fluid and/or transporting fluid along various pathways. The fluid that is ejected and moved throughout the fluidic die (100) can be of various types including ink, biochemical agents, and/or fusing agents. The fluid is moved and/or ejected via an array of fluid actuators (106). Any number of fluid actuators (106) may be formed on the fluidic die (100).

The fluidic die (100) includes an array of firing subassemblies (102). The firing chambers (104) of the firing subassemblies (102) include a fluid actuator (106) disposed therein, which fluid actuator (106) works to eject fluid from, or move fluid throughout, the fluidic die (100). The fluid chambers (104) and fluid actuators (106) may be of varying types. For example, the firing chamber (104) may be an ejection chamber wherein fluid is expelled from the fluidic die (100) onto a surface for example such as paper or a 3D build bed. In this example, the fluid actuator (106) may be an ejector that ejects fluid through an opening of the firing chamber (104).

In another example, the firing chamber (104) is a channel through which fluid flows. That is, the fluidic die (101) may include an array of microfluidic channels. Each microfluidic channel includes a fluid actuator (106) that is a fluid pump. In this example, the fluid pump, when activated, displaces fluid within the microfluidic channel. While the present specification may make reference to particular types of fluid actuators (106), the fluidic die (100) may include any number and type of fluid actuators (106).

Figure 2:
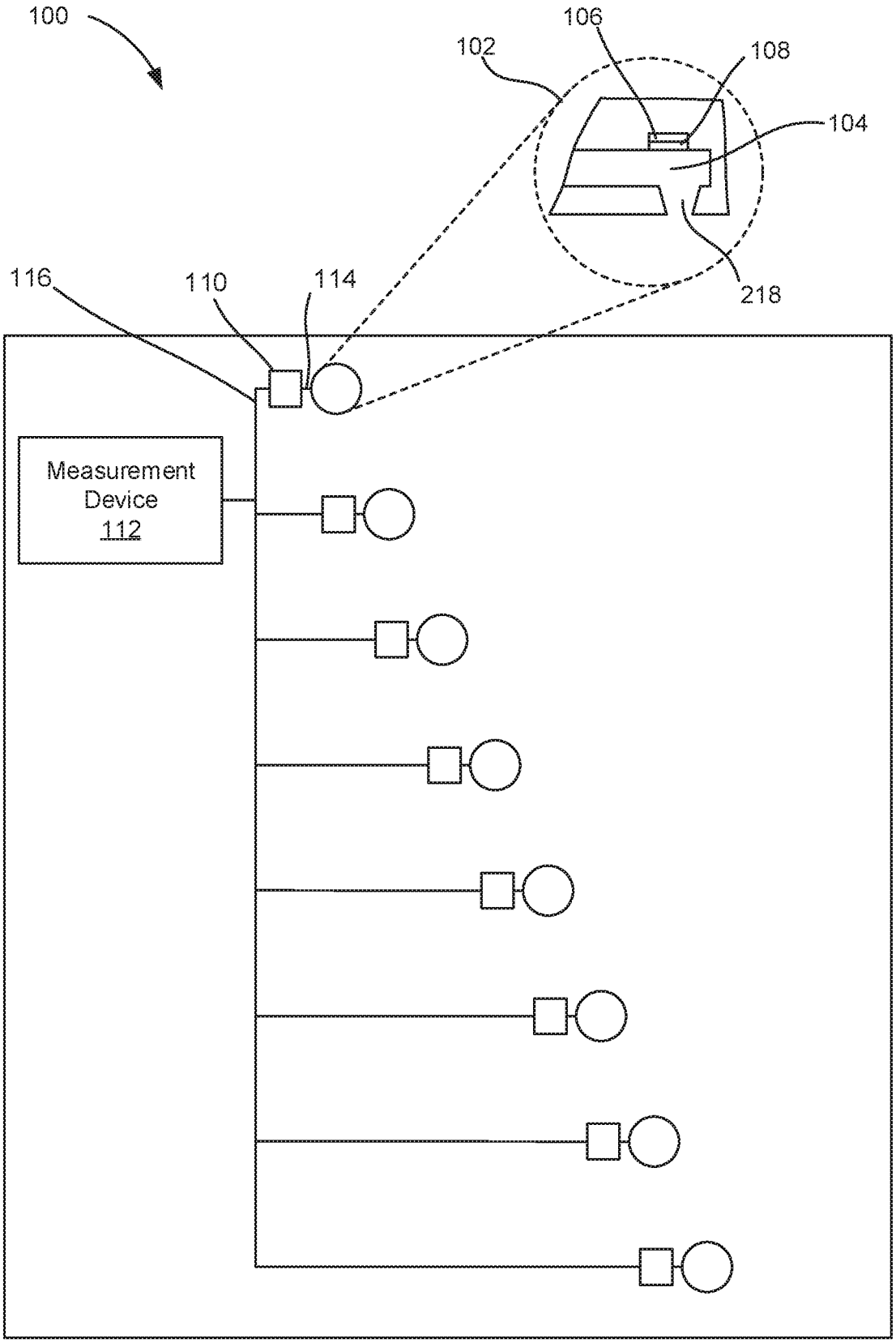
FIG. 2 is a diagram of a fluidic die with a selector adjacent a respective firing subassembly, according to an example of the principles described herein.

Each firing subassembly (102) also includes a sensor plate (108). In some examples, as depicted in FIG. 2, the sensor plate (108) is disposed within the firing chamber (104). The sensor plate (108) senses a characteristic of a corresponding fluid actuator (106). For example, the sensor plate (108) may measure an impedance near a fluid actuator (106). In a specific example, the sensor plates (108) are drive bubble detectors that detect the presence, or absence, of fluid in the firing chamber (104) during a firing event of the fluid actuator (106).

In this example, a drive bubble is generated by a fluid actuator (106) to move fluid in, or eject fluid from, the firing chamber (104). Specifically, in thermal inkjet printing, a thermal ejector heats up to vaporize a portion of fluid in a firing chamber (104). As the bubble expands, it forces fluid out of the firing chamber (104). As the bubble collapses, a negative pressure and/or capillary force within the firing chamber (104) draws fluid from the fluid source, such as a fluid feed slot or fluid feed holes, to the fluidic die (100). Sensing the proper formation and collapse of such a drive bubble can be used to evaluate whether a particular fluid actuator (106) is operating as expected. That is, a blockage in the firing chamber (104) will affect the formation of the drive bubble. If a drive bubble has not formed as expected, it can be determined that the nozzle is blocked and/or not working in the intended manner.

The presence of a drive bubble can be detected by measuring impedance values within the firing chamber (104). That is, as the vapor that makes up the drive bubble has a different conductivity than the fluid that otherwise is disposed within the chamber, when a drive bubble exists in the firing chamber (104), a different impedance value will be measured. Accordingly, a drive bubble detection device measures this impedance and outputs a corresponding voltage. As will be described below, this output can be used to determine whether a drive bubble is properly forming and therefore determine whether the corresponding ejector or pump is in a functioning or malfunctioning state.

The firing subassemblies (102) may be grouped into zones. For example, a group of eight firing subassemblies (102) may be formed into one zone. While specific reference is made to eight firing subassemblies (102) being formed into a zone, any number of firing subassemblies (102) may be formed into a zone.

The fluidic die (100) also includes a measurement device (112) per zone. The measurement device (112) measures a voltage associated with a measured impedance within a firing chamber (104). This measured voltage is then used to determine a state of the firing subassembly (102). For example, a sensor plate (108) may output multiple values that correspond to impedance measurements within a firing chamber (104) at different points in time. These values can be compared against a difference threshold. The threshold delineates between a proper bubble formation and a faulty bubble formation.

As a specific example, a voltage difference is calculated between measurements taken at a peak time and a refill time, a voltage difference that is lower than or greater than a threshold may indicate improper bubble formation and collapse. Accordingly, a voltage difference greater than or less than the threshold may indicate proper bubble formation and collapse. While a specific relationship, i.e., low voltage difference indicating improper bubble formation, high voltage difference indicating proper bubble formation, has been described, any desired relationship can be implemented in accordance with the principles described herein.

As multiple firing subassemblies (102) are coupled to a single measurement device (112), each firing subassembly (102) is coupled to a selector (110) that couples a respective sensor plate (108) to the measurement device (112). For example, it may be too complex, costly, and large to include a measurement device (112) per firing subassembly (102). Accordingly, the measurement device (112) is multiplexed to multiple firing subassemblies (102). Accordingly, a select signal is passed to a particular selector (110) which couples the corresponding firing subassembly (102) to the measurement device (112).

Each sensor plate (108) is coupled to the measurement device (112) via a path with two legs. A first leg (114) couples each selector (110) to its respective sensor plate (108) and a second leg (116) couples the selector (110) to the measurement device (112). As described above, if these legs (114, 116) are different in length, width, or composition or are not connected in parallel, then the parasitic capacitance on the paths will be different. This difference can alter firing subassembly (102) evaluation.

For example, a first sensor plate (108) may have a first voltage response to an applied stimulus. The first voltage response is transmitted as a first voltage value along a corresponding transmission path to the measurement device (112). The measurement device (112) then uses the received first voltage value to determine a state of the first firing subassembly (102).

In this example, a second sensor plate (108) may have a longer transmission path than that associated with the first sensor plate (108), and therefore has a different parasitic capacitance. Accordingly, the second sensor plate (108) may have a response to the stimulus that is different than the first voltage response. This second voltage response is transmitted as a second voltage value to the measurement device (112), which second voltage value is different than the first voltage value. Accordingly, the value that is ultimately received at the measurement device (112) may be a different value than what is received along the first transmission path, notwithstanding each sensor plate (108) may be in the same state. The difference in the received values could lead to a different state determination, even though they are actually at the same state, i.e., the same impedance value detected at the sensor plate (108). For example, both firing subassemblies (102) may be healthy, but the different parasitic capacitances could lead to a determination that one is unhealthy based on the alteration of the signal passing from the sensor plate (108) to the measurement device (112). In other words, the parasitic capacitance along a transmission path affects the received voltage. Accordingly, it is desirable that the effects are the same across all firing subassemblies (102) within a zone.

Accordingly, the present fluidic die (100) aligns the parasitic capacitance along these transmission paths. First, the second leg (116) from each selector (110) is parallel with other second legs (116). That is, the path between each selector (110) and the measurement device (112) shares a common node such that any parasitic capacitance along the second leg (116) is common/seen by all selectors (110).

Second, the selector(s) (110) for each firing subassembly (102) are adjacent a respective firing subassembly (102). That is, rather than placing the selector (110) adjacent the measurement device (112) such that a path between selector (110)/sensor plate (108) is different, the selector (110) is placed adjacent the respective firing subassembly (108) such that a path between the selector (110)/sensor plate (108) is the same. That is, a distance between each selector (110) and the measurement device (112) is different but shared, while the spacing between the sensor plate (108) and the selector (110) may be the same.

For example, a first sensor plate (108) may be a first distance away from its associated selector (110) and a second sensor plate (108) may also be a first distance away from its associated selector (110). Accordingly, the first leg (114) in each transmission path is the same length, regardless of a distance of the firing subassembly (102) to the measurement device (112). Accordingly, in these examples the legs (114, 116) of the transmission path are either the same length or shared, thus the parasitic capacitance along these transmission paths is the same.

Doing so ensures a consistent and repeatable state determination. That is, during firing subassembly (102) state determination, there are various sources of variation. However, the fluidic die (100) as described herein alleviates some of that variation by eliminating variation of measurement values as received at the measurement device (112). Elimination or reduction of this variation allows for more accurate firing subassembly (102) health determination. Thus, the accuracy of any voltage values measured by the measurement device (112) can be relied on with greater certainty. Thus, subsequent calibration and/or state determinations can be made with greater assurance of their actual reflection of conditions within the firing subassembly (102).

FIG. 2 is a diagram of a fluidic die (100) with a selector (110) adjacent a respective firing subassembly (102), according to an example of the principles described herein. As described above, the fluidic die (100) includes an array of firing subassemblies (102). For simplicity in FIG. 2, the firing subassemblies (102) are enlarged to show detail and the relative size between different components may not be representative of actual sizes. Moreover, for simplicity a single instance of a first leg (114), selector (110), and second leg (116) are identified with a reference number.

As described above, each firing subassembly (102) includes various components to eject/move fluid. In the example, depicted in FIG. 2, the firing subassembly (102) is an ejection subassembly that ejects fluid. In this example, the firing subassembly (102) includes the fluid actuator (106), firing chamber (104), and an opening (218) through which fluid is expelled. As described above, the fluid actuator (106) may be a mechanism for ejecting fluid through the opening (218) of the firing chamber (104). The fluid actuator (106) may include a firing resistor or other thermal device, a piezoelectric element, or other mechanism for ejecting fluid from the firing chamber (104).

For example, the fluid actuator (106) may be a firing resistor. The firing resistor heats up in response to an applied voltage. As the firing resistor heats up, a portion of the fluid in the firing chamber (104) vaporizes to form a bubble. This bubble pushes liquid fluid out the opening (218) and onto the print medium. As the vaporized fluid bubble collapses, a vacuum pressure along with capillary force within the firing chamber (104) draws fluid into the firing chamber (104) from a reservoir, and the process repeats. In this example, the fluidic die (100) may be a thermal inkjet fluidic die (100).

In another example, the fluid actuator (106) may be a piezoelectric device. As a voltage is applied, the piezoelectric device changes shape which generates a pressure pulse in the firing chamber (104) that pushes a fluid out the opening (218) and onto the print medium. In this example, the fluidic die (110) may be a piezoelectric inkjet fluidic die (100).

Structurally the sensor plate (108) may include a single electrically conductive plate, such as a tantalum plate, which can detect an impedance of whatever medium is within the firing chamber (104). Specifically, each sensor plate (108) measures an impedance of the medium within the firing chamber (104), which impedance measurement, as described above, can indicate whether a drive bubble is properly forming in the firing chamber (104). The sensor plate (108) then outputs voltage values indicative of a state, i.e., drive bubble formed or not, of the corresponding fluid actuator (106). This output can be compared against threshold values to determine whether the fluid actuator (106) is malfunctioning or otherwise inoperable.

In some examples, the firing subassemblies (102) are formed into angled columns. Specifically, the distance between firing subassemblies (102) and the measurement device (112) increases going along the angled column. While specific reference is made to an angled column arrangement, other arrangements are possible as well where distances between the measurement device (112) and the firing subassemblies (102) are different.

As described above this increased distance, if not addressed, can introduce variation into the measurements taken by the measurement device (112). In some cases, the difference in distance can be substantial and thus result in substantial measurement variation if left unaddressed. For example, a shortest distance between a first firing subassembly (102) at the top of the angled column, and the measurement device (112) may be at least ten times shorter than a longest distance between a second firing subassembly (102) at the bottom of the angled column.

The present fluidic die (100) addresses this by placing the selector (110) near its corresponding firing subassembly (102). That is, the angled columns of firing subassemblies (102) create extra space on the fluidic die (100) such that the selectors (110) can be placed adjacent the firing subassemblies (102). Of particular note, the distance between each selector (110) and juxtaposed firing subassembly (102) is the same across the fluidic die (100). Doing so ensures that the first leg (114) parasitic capacitance is uniform for each selector (110)/sensor plate (108) pair. Making the first leg (114) short by placing it adjacent the corresponding sensor plate (108) also reduces the overall parasitic capacitance of the first leg (114). The spacing of a selector (110) and the corresponding firing subassembly (102) may be selected such that a parasitic capacitance along this first leg (114) is less than a predetermined amount, the predetermined amount being selected based on application.

To alleviate any variation between parasitic capacitance on the second leg (116) of each transmission path, each selector (110) may share a measurement device (112) node with other selectors (110). That is, a parasitic capacitance between a particular selector (110) and the measurement device (112) is seen by and common to all selectors (110). As each selector (110) is coupled to one another along the second leg (116) there is no variation in parasitic capacitance between the second legs (116) of the transmission paths.

Figure 3:
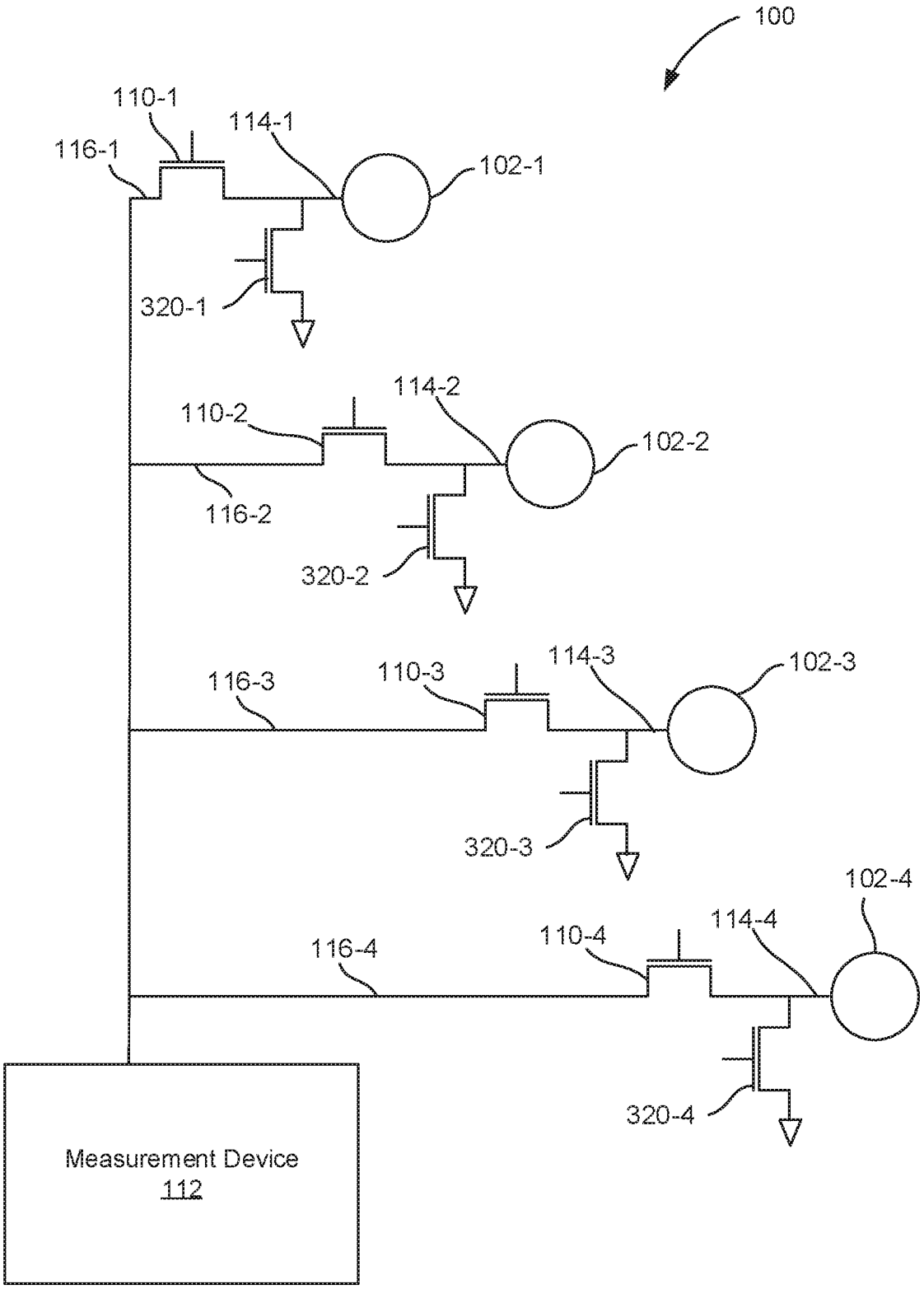
FIG. 3 is a circuit diagram of a fluidic die with a selector adjacent a respective firing subassembly, according to an example of the principles described herein.

FIG. 3 is a circuit diagram of a fluidic die (100) with a selector (110) adjacent a respective firing subassembly (102), according to an example of the principles described herein. For simplicity, FIG. 3 depicts a few instances of some of the components. However, the fluidic die (100) may include any number of these components.

As described above, the selectors (110-1, 110-2, 110-3, 110-4) may operate to couple a particular firing subassembly (102-1, 102-2, 102-3, 102-4), and more specifically a sensor plate (FIG. 1, 108) of the firing subassembly (102), to a measurement device (112). As depicted in FIG. 3, the selectors (110) may be field-effect transistors (FETs) such as PMOS FETs or NMOS FETs. In this example, a select signal is passed to a gate of a particular selector (110) which generates a closed path between the sensor plate (FIG. 1, 108) of the firing subassembly (102) and the measurement device (112) such that voltage measurements within the firing chamber (FIG. 1, 104) may be made.

That is, to perform a fluid actuator (FIG. 1, 106) measurement, a single selector (110) is enabled. As a result, the measurement device (112) is coupled to just one sensor plate (FIG. 1, 108). The measurement device (112) then forces a current onto the selected sensor plate (FIG. 1, 108) and after a predetermined amount of time, the measurement device (112) receives a signal, i.e., a voltage, indicative of an impedance within the firing chamber (FIG. 1, 104).

In this example, the voltage received at the measurement device (112) is a function of the impedance in the firing chamber (FIG. 1, 104) as well as 1) a parasitic capacitance on the first leg (114-1, 114-2, 114-3, 114-4) between a selector (110) and a sensor plate (FIGS. 1, 108) and 2) a parasitic capacitance on the second leg (116-1, 116-2, 116-3, 116-4) between the selector (110) and the measurement device (112). In any measurement operation, it is desirable to isolate the measured voltage to have a reliable mapping to the measured impedance. Accordingly, it is desirable to remove any variation resulting from the parasitic capacitances. The parasitic capacitance between the selectors (110) and the measurement device (112) is shared by all selectors (110) and is thus the same with no variation between them. The parasitic capacitance between the selectors (110) and the respective sensor plates (FIG. 1, 108) is the same due to the similar distance there between and thus there is no variation across them. Accordingly, the measurement device (112) receives values that can be mapped to actuator state regardless of the position of the firing subassembly (102) relative to the measurement device (112).

In some examples, each transmission path may include a pull down transistor (320-1, 320-2, 320-3, 320-4) to 1) reset the sensor plate (FIG. 1, 108) to a predetermined voltage before measurement, 2) maintain the sensor plate (FIG. 1, 108) at a safe voltage when firing, and 3) to conduct electrical leakage tests between neighboring sensor plates (FIG. 1, 108). As indicated in FIG. 3, each pull-down transistor (320) may adjacent the respective firing subassembly (102), specifically along a first leg (114) of the transmission path.

Figure 4:
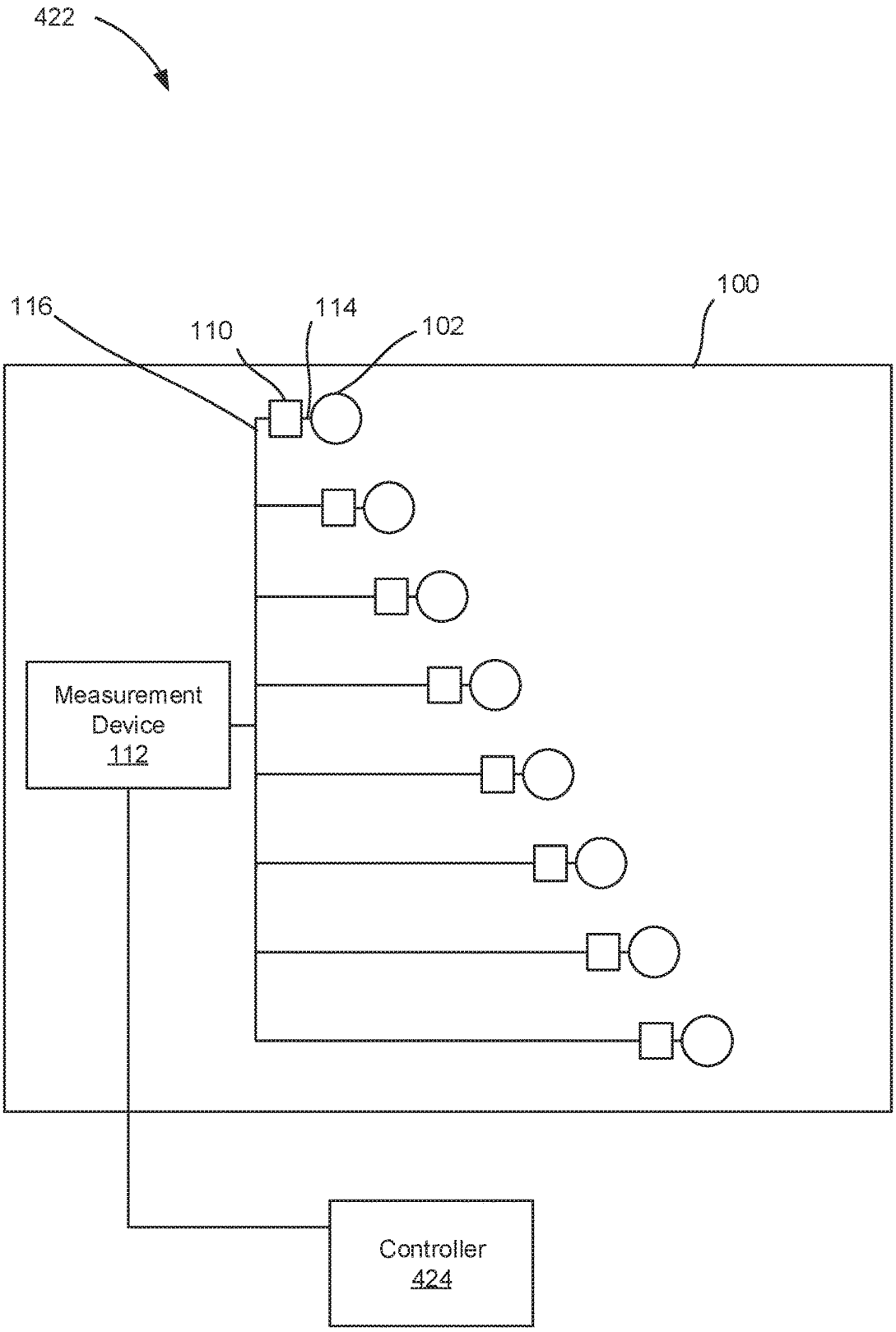
FIG. 4 is a diagram of a fluidic system with a fluidic die with a selector adjacent a respective firing subassembly, according to an example of the principles described herein.

FIG. 4 is a diagram of a fluidic system (422) with a fluidic die (100) with a selector (110) adjacent a respective firing subassembly (102), according to an example of the principles described herein. For simplicity, a single instance of various components are identified with a reference number. As described, the fluidic die (100) includes firing assemblies (102) with respective selectors (110) placed adjacent and each firing subassembly (102)/selector (110) leg (114) having the same distance. In this example, the firing subassembly (102) to measurement device (112) distance may differ per firing subassembly (102) on account of the firing subassemblies (102) being arranged in angled columns. However, on account of the selectors (110)/measurement device (112) legs (116) having a shared node, the parasitic capacitance along these legs (116) is the same.

As described above, the measurement device (112) is individually coupled to a particular sensor plate (FIG. 1, 108) via a selector (110). The measurement device (112) then forces a current onto the sensor plate (FIG. 1,108) and an impedance detected within the firing chamber (FIG. 1, 104). The measurement device (112) then receives a voltage and passes the voltage onto a controller (424). That is, the measurement device (112) outputs a signal by which a firing subassembly (102) health is determined.

The controller (424) of the fluidic system (422) determines a state of the selected firing subassembly (102). That is, the fluidic system (422) may receive a voltage and compare it to a database of known values. Based on this comparison, the controller (424) may determine whether the particular firing subassembly (102) is healthy or not. In some examples, the controller (424) may be disposed off the fluidic die (100) on another substrate.

In one example, using such a fluidic die 1) makes the parasitic capacitance of the various transmission paths on a fluidic die uniform; 2) provides consistent data on which subsequent voltage-to-state mappings can rely; 3) allows for accurate, repeatable, and consistent actuator evaluation; and 4) capitalizes on available spaced on the fluidic die.

What is claimed is:

1. A fluidic die, comprising:

an array of firing subassemblies grouped into zones, each firing subassembly comprising:

a firing chamber;

a fluid actuator disposed within the firing chamber; and a sensor plate disposed within the firing chamber;

a measurement device per zone to measure a voltage indicative of an impedance within a selected firing chamber; and a selector per firing subassembly to couple a selected sensor plate to the measurement device, wherein:

each selector is adjacent a respective firing subassembly; and a distance between the selector and the measurement device is different as compared to at least one other selector.

2. The fluidic die of claim 1, wherein the measurement device:

forces a current onto the sensor plate associated with the selected firing subassembly; and receives a signal indicative of an impedance within the selected firing chamber.

3. The fluidic die of claim 2, wherein the measurement device measures the signal indicative of the impedance after a predetermined period of time after forcing the current onto the sensor plate.

4. The fluidic die of claim 1, wherein a distance between the selector and its associated sensor plate is the same as compared to other selectors.

5. The fluidic die of claim 1, wherein:

a parasitic capacitance between each selector and a respective firing subassembly is uniform; and a parasitic capacitance between each selector and the measurement device is seen by all selectors.

6. The fluidic die of claim 1, wherein a node between the measurement device and the selector is shared between each firing subassembly in the zone.

7. The fluidic die of claim 1, further comprising a pull-down transistor per firing subassembly.

8. The fluidic die of claim 7, wherein the pull-down transistor is adjacent a respective firing subassembly.

9. The fluidic die of claim 7, wherein the pull-down transistor is between a respective selector and firing subassembly.

10. The fluidic die of claim 1, wherein the sensor plate is a drive bubble detector to detect the presence of a drive bubble in the firing chamber.

11. The fluidic die of claim 1, wherein:

the sensor plate is to output different impedance measurements over time of a bubble formation in the firing chamber; and the measurement device compares each impedance measurement against a different threshold.

12. The fluidic die of claim 1, wherein a spacing between the selector and the respective firing subassembly is selected based on a target parasitic capacitance.

13. A fluidic die, comprising:

an array of firing subassemblies grouped into zones wherein:

the array comprises an angled column of firing subassemblies; and each firing subassembly comprises:

a firing chamber;

a fluid actuator disposed within the firing chamber; and a sensor plate disposed within the firing chamber;

a measurement device per zone to measure a voltage indicative of an impedance within a selected firing chamber; and a selector per firing subassembly to couple a selected sensor plate to the measurement device, wherein:

the selector is adjacent a respective ejection subassembly;

a parasitic capacitance along a path between each respective sensor plate and selector is uniform;

a distance between the selector and the measurement device is different as compared to at least one other selector; and a distance between the selector and its associated sensor plate is the same as compared to other selectors.

14. The fluidic die of claim 13, wherein distances between each firing subassembly and the measurement device increases going along the angled column.

15. The fluidic die of claim 13, wherein a shortest distance between a first firing subassembly and the measurement device is at least ten times shorter than a longest distance between a second firing subassembly and the measurement device.

16. The fluidic die of claim 13, wherein the measurement device is coupled to each selector such that parasitic capacitance between each selector and the measurement device is shared.

17. The fluidic die of claim 13, wherein the measurement device outputs a signal by which a firing subassembly health is determined.

18. A fluidic system comprising:

a fluidic die, comprising:

an array of firing subassemblies grouped into zones, each firing subassembly comprising:

a firing chamber;

a fluid actuator disposed within the firing chamber; and a sensor plate disposed within the firing chamber;

a measurement device per zone to measure a voltage indicative of an impedance within a selected firing chamber; and a selector per firing subassembly to couple a selected sensor plate to the measurement device, wherein:

the selector is adjacent a respective firing subassembly; and a distance between the selector and the measurement device is different as compared to at least one other selector; and a controller to, based on an output of the measurement device, determine a state of a selected firing subassembly.

19. The fluidic system of claim 18, wherein the controller is disposed off the fluidic die.

20. The fluidic system of claim 18, wherein each selector is positioned relative to the respective firing subassembly such that a parasitic capacitance between the selector and respective sensor is less than a predetermined amount.

* * * * *